US011000884B2

(12) United States Patent
Robinson

(10) Patent No.: US 11,000,884 B2
(45) Date of Patent: May 11, 2021

(54) PORTABLE CLEANING SYSTEM AND METHOD FOR CLEANING COMMERCIAL FOOD AND BEVERAGE REFRIGERATION UNITS

(71) Applicant: Robert S. Robinson, Hamilton, OH (US)

(72) Inventor: Robert S. Robinson, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 0 days.

(21) Appl. No.: 16/152,408

(22) Filed: Oct. 4, 2018

(65) Prior Publication Data

US 2020/0230669 A1 Jul. 23, 2020

Related U.S. Application Data

(60) Provisional application No. 62/740,945, filed on Oct. 3, 2018, provisional application No. 62/568,085, filed on Oct. 4, 2017.

(51) Int. Cl.
*B08B 9/093* (2006.01)
*B08B 5/04* (2006.01)

(52) U.S. Cl.
CPC ..... *B08B 9/093* (2013.01); *B08B 5/04* (2013.01)

(58) Field of Classification Search
CPC . B08B 9/093; B08B 5/04; F25D 21/10; F28G 1/00
See application file for complete search history.

(56) References Cited

U.S. PATENT DOCUMENTS

| | | | | |
|---|---|---|---|---|
| 7,272,869 | B1 | 9/2007 | Robinson | |
| 10,368,710 | B1 * | 8/2019 | Robinson | B08B 3/026 |
| 2005/0138946 | A1 | 6/2005 | Sauter | |

(Continued)

FOREIGN PATENT DOCUMENTS

| | | |
|---|---|---|
| CA | 2647554 | 10/2007 |
| DE | 20307165 | 9/2003 |
| GB | 2112511 | 7/1983 |

OTHER PUBLICATIONS

International Search Report (including information on search strategy) (6 pages) for International Application No. PCT/US2018/054481, van der Zee, Willem (Authorized officer), dated Jan. 25, 2019 (mailing date), EPO (International Searching Authority).

*Primary Examiner* — Sharidan Carrillo
(74) *Attorney, Agent, or Firm* — David E. Pritchard

(57) ABSTRACT

A system for cleaning a commercial food or beverage refrigeration unit may include: a liquid tank; a pump; a vacuum recovery tank; a vacuum motor assembly; a spray wand; a drain stopper; and a suction tool. The refrigeration unit may include a rack, a tray, a fan, a fan housing, a fan power cord, a fan housing power outlet, a coolant, a coolant coil, a pan, and a drain. A method of cleaning the refrigeration unit may include: filling the liquid tank; rinsing the rack by spraying liquid onto the rack; removing the rack; rinsing the tray by spraying liquid onto the tray; removing the tray; stopping the fan; stopping the flow of the coolant; positioning the drain stopper; elevating the fan housing; rinsing the coil by spraying liquid onto the coil; positioning the suction tool on the pan; and vacuuming soil and sprayed liquid into the vacuum recovery tank.

9 Claims, 16 Drawing Sheets

(56) References Cited

U.S. PATENT DOCUMENTS

| | | | | |
|---|---|---|---|---|
| 2010/0125969 | A1 | 5/2010 | Genna et al. | |
| 2016/0088986 | A1* | 3/2016 | Kane | B08B 3/026 15/320 |
| 2017/0157652 | A1 | 6/2017 | Campbell | |
| 2020/0230669 | A1* | 7/2020 | Robinson | B08B 9/093 |

* cited by examiner

PORTABLE CLEANING SYSTEM AND METHOD FOR CLEANING COMMERCIAL FOOD AND BEVERAGE REFRIGERATION UNITS

CROSS-REFERENCE TO RELATED APPLICATION

This patent document claims the benefit of the filing date of Provisional Application No. 62/568,085, entitled "Portable Cleaning System and Method for Cleaning Commercial Food and Beverage Refrigeration Units" and filed on Oct. 4, 2017, and of Provisional Application No. 62/740,945, entitled "Portable Cleaning System and Method for Cleaning Commercial Food and Beverage Refrigeration Units" and filed on Oct. 3, 2018. The entire disclosure of each of Provisional Application No. 62/568,085 and Provisional Application No. 62/740,945 is incorporated into this patent document by reference.

BACKGROUND OF THE INVENTION

This invention relates to cleaning commercial food and beverage refrigeration units.

SUMMARY OF THE INVENTION

One aspect of the invention is directed to a method of cleaning a commercial food or beverage refrigeration unit. Such a refrigeration unit may include at least one open rack, at least one drip tray, a fan, a fan housing, a fan power cord, a fan housing power outlet, a coolant, a coolant coil, a drain pan, and a drain.

The method may include: providing a portable cleaning system, comprising: a liquid tank; a pump fluidly connected to the liquid tank; a vacuum recovery tank; a vacuum motor assembly fluidly connected to the vacuum recovery tank; a spray wand fluidly connectable to the pump and the liquid tank; a drain stopper; and a suction tool fluidly connectable to the vacuum recovery tank.

The method also may include: filling at least a portion of the liquid tank with a liquid; rinsing the open rack by spraying liquid with the spray wand from the liquid tank onto the open rack; removing the open rack from the refrigeration unit; rinsing the drip tray by spraying liquid with the spray wand from the liquid tank onto the drip tray; removing the drip tray from the refrigeration unit; stopping the fan; stopping the flow of the coolant; positioning the drain stopper in the drain; elevating a front portion of the fan housing, thereby providing spraying access to the coolant coil; rinsing the coolant coil by spraying liquid with the spray wand from the liquid tank onto the coolant coil; positioning the suction tool on the drain pan, with the suction tool fluidly connected to the vacuum recovery tank; and vacuuming soil and sprayed liquid through the suction tool into the vacuum recovery tank.

The method may further include: positioning at least one temporary support member between the front portion of the fan housing and the drain pan, to facilitate temporarily maintaining the front portion in an elevated position; scrubbing one or more of the open rack, the drip tray, and the drain pan; and/or vacuuming dust from the fan into the vacuum recovery tank.

In addition, the method may include: removing the drain stopper from the drain; removing the suction tool from the refrigeration unit; removing the temporary support member and lowering the front portion of the fan housing; starting the fan; starting the flow of the coolant; and/or repositioning the drip tray and the open rack in the refrigeration unit.

Also, as a part of the method: suction from the vacuum motor assembly may releasably maintain the suction tool in place when the suction tool is positioned on the drain pan; the liquid entering the liquid tank during filling may have a temperature above ambient temperature; the liquid entering the liquid tank during filling may be water, and the liquid used in rinsing may be water; and/or the portable cleaning system may further include a vacuum hose.

Another aspect of the invention is directed to a portable cleaning system for use in cleaning a commercial food or beverage refrigeration unit. The system may include: a liquid tank; a pump fluidly connected to the liquid tank; a vacuum recovery tank; a vacuum motor assembly fluidly connected to the vacuum recovery tank; a spray wand fluidly connectable to the pump and the liquid tank; a drain stopper; and a suction tool fluidly connectable to the vacuum recovery tank.

A commercial food or beverage refrigeration unit may include at least one open rack, at least one drip tray, a fan, a fan housing, a fan power cord, a fan housing power outlet, a coolant, a coolant coil, a drain pan, and a drain.

In this fashion, a user may clean the refrigeration unit by: filling at least a portion of the liquid tank with a liquid; rinsing the open rack by spraying liquid with the spray wand from the liquid tank onto the open rack; removing the open rack from the refrigeration unit; rinsing the drip tray by spraying liquid with the spray wand from the liquid tank onto the drip tray; removing the drip tray from the refrigeration unit; stopping the fan; stopping the flow of the coolant; positioning the drain stopper in the drain; elevating a front portion of the fan housing, thereby providing spraying access to the coolant coil; rinsing the coolant coil by spraying liquid with the spray wand from the liquid tank onto the coolant coil; positioning the suction tool on the drain pan, with the suction tool fluidly connected to the vacuum recovery tank; and vacuuming soil and sprayed liquid through the suction tool into the vacuum recovery tank.

The system also may include at least one temporary support member, with the temporary support member positionable between a front portion of a refrigeration unit fan housing and a refrigeration unit drain pan when the front portion is in an elevated position, to facilitate temporarily maintaining the front portion in the elevated position.

The system may further include a vacuum hose fluidly connectable to the vacuum recovery tank.

The portable cleaning system is suitable for use in cleaning different types and styles of commercial food and beverage refrigeration units. Non-limiting examples of such refrigeration units include open display refrigerator cases (a.k.a. open-air refrigerator cases), open display freezer cases (a.k.a. open-air freezer cases), reach-in refrigerator cases (with or without doors or curtains), reach-in freezer cases (with or without doors or curtains), cooler cases, freezer cases, walk-in coolers, and walk-in freezers.

If desired, a portable cleaning system for cleaning commercial food and beverage refrigeration units, in accordance with the principles of the invention, may include a fresh liquid tank assembly (for holding water or another suitable cleaning chemical or chemicals), a vacuum recovery tank assembly, a black box assembly, a pump assembly, and a vacuum motor assembly. A portable cleaning system of the invention also may include a high-pressure spray line, a high-pressure spray wand, a low-pressure spray wand, a vacuum hose, a vacuum wand, and one or more tools for attachment to the vacuum hose or the vacuum wand. For example, the system may include a suction tool for attachment to the vacuum hose and for placement near or on a refrigeration unit drain. In this patent document, one tool for placement near a refrigeration unit drain is referred to as a gulper tool (also referred to herein as an instant drain tool, an Insta-Drain, or a KaiDrain); and another tool for placement on (and partially in) a refrigeration unit drain is referred to as a universal drain suction tool.

A portable cleaning system of the invention may be powered by AC power or by DC power. Any suitable pump may be used. If desired, the pump may be a diaphragm pump. Also, if desired, the pump may have a pressure of from about 30 PSI to about 500 PSI, of from about 40 PSI to about 75 PSI, or about 100 PSI. Further, if desired, the pump may have a flow rate of from about 0.5 GPM to about 2 GPM, or about 1 GPM. Any suitable vacuum motor assembly may be used. If desired, the vacuum motor assembly may be a three-stage vacuum motor assembly.

With regard to the fresh liquid used in a portable cleaning system of the invention, if desired, water (e.g., tap water) may be used to advantage. For example, the water may be water from a hot-water tap, a cold-water tap, or both hot- and cold-water taps. Also, if desired, it may be advantageous to use water from a hot-water tap, as opposed to water from a cold-water tap.

In addition, a few aspects of the embodiment of a portable cleaning system for cleaning commercial food and beverage refrigeration units are disclosed in U.S. patent application Ser. No. 11/823,131, entitled "Ergonomic Multi-Functional Cleaning Machine" and filed on Jun. 27, 2007. The entire disclosure of U.S. patent application Ser. No. 11/823,131 is incorporated into this patent document by reference.

A portable cleaning system for cleaning commercial food and beverage refrigeration units, in accordance with the principles of the invention, may be made using any suitable materials and manufacturing techniques.

BRIEF DESCRIPTION OF THE DRAWINGS

The accompanying drawings, which are incorporated into this patent document and constitute a part of this specification, illustrate embodiments of the invention and, together with the general description of the invention given above and the detailed description of the drawings given below, serve to explain the principles of the invention.

FIG. 1 also shows a user adding hot water from a hot water faucet to a liquid tank of the portable cleaning system.

FIG. 2 also shows a user unwrapping a spray hose of the portable cleaning system.

FIG. 4 also shows a user lifting an open rack of the cooler case.

FIG. 5 also shows a user lifting a drip tray of the cooler case.

FIG. 6 also shows a user rinsing one of the drip trays by spraying liquid onto the drip tray via the spray hose and a spray wand of the portable cleaning system of FIG. 1.

FIG. 7 also shows a user holding a fan power cord of the cooler case.

FIG. 8 also shows a user turning a coolant valve of the cooler case.

FIG. 9 also shows a user vacuuming a drain pan of the cooler case with a crevice tool of the portable cleaning system of FIG. 1.

FIG. 10 also shows a user vacuuming a fan blade of a cooler case fan with a dusting brush tool of the portable cleaning system of FIG. 1.

FIG. 11 also shows a user placing a drain stopper tool of the portable cleaning system of FIG. 1 in a drain of the cooler case.

FIG. 12 also shows a user using lifting a front portion of a fan housing of the cooler case and positioning a temporary support member (a.k.a. fan lift tool) of the portable cleaning system of FIG. 1 to support the fan housing in an upright position.

FIG. 13 also shows rinsing the coolant coil by spraying liquid onto the coolant coil via the spray wand of the portable cleaning system of FIG. 1. The spray wand is held by a user (not shown).

FIG. 14 also shows a suction tool (a.k.a. Insta-Drain tool) connected to a vacuum hose, and a user positioning the suction tool on the drain pan. The suction tool and the vacuum hose are components of the portable cleaning system of FIG. 1.

FIG. 15 also shows a user emptying the contents of a vacuum recovery tank of the portable cleaning system into the floor sink via a dump hose of the portable cleaning system.

FIG. 16 also shows a user inserting a charger plug of a battery charger into the charging port.

DETAILED DESCRIPTION OF A PARTICULAR EMBODIMENT OF THE PORTABLE CLEANING SYSTEM, AND OF THE METHOD, FOR CLEANING COMMERCIAL FOOD AND BEVERAGE REFRIGERATION UNITS

A particular embodiment of the portable cleaning system for cleaning commercial food and beverage refrigeration units, in accordance with the principles of the invention, is described below. In addition, a particular embodiment of the method of cleaning commercial food and beverage refrigeration units, in accordance with the principles of the invention, is described below. The particular method embodiment described includes a method of cleaning a cooler case.

Figure 1:
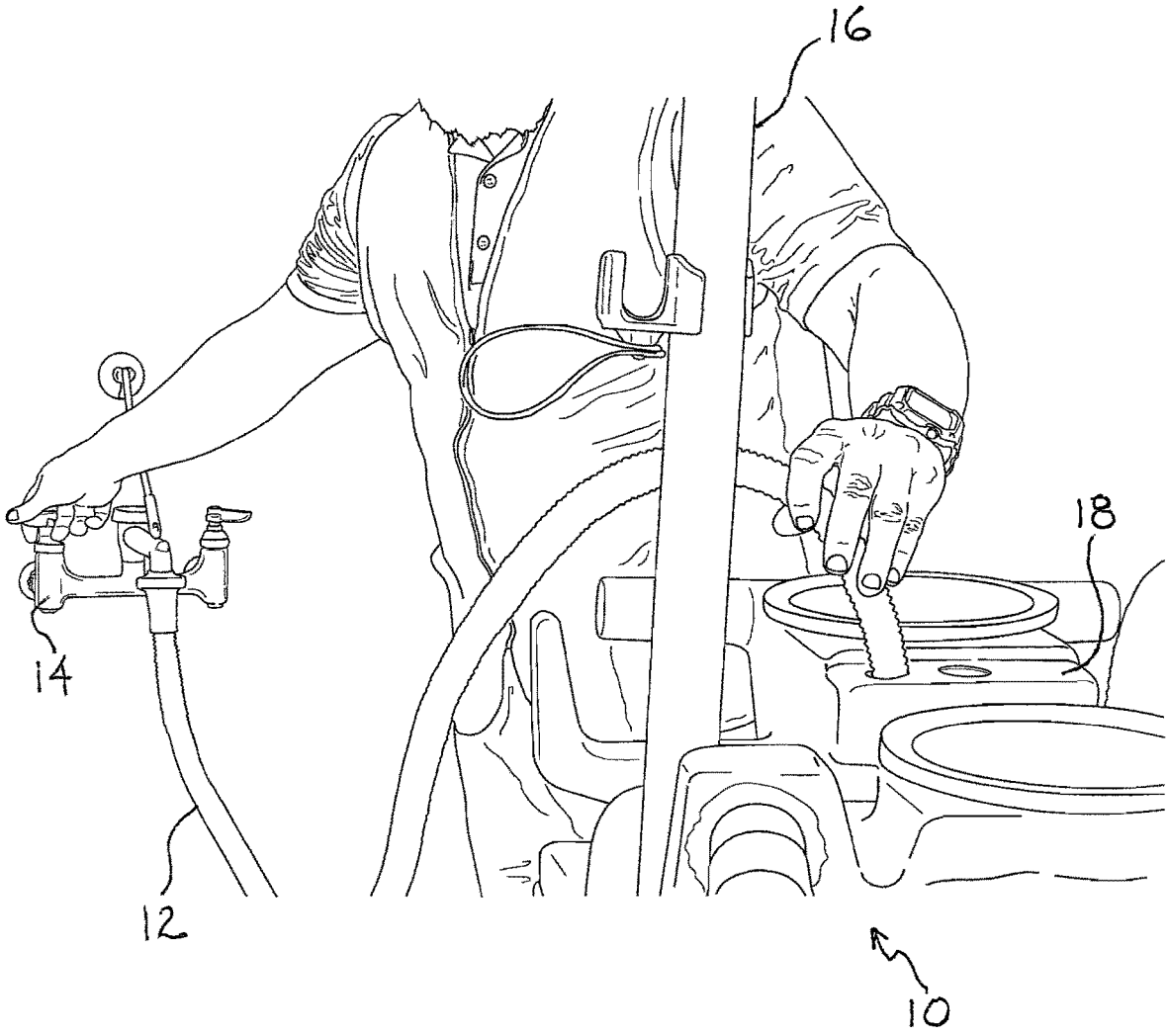
FIG. 1 is a perspective view of a portion of an embodiment of the portable cleaning system for use in cleaning a commercial food or beverage refrigeration unit, in accordance with the principles of the invention.
Figure 2:
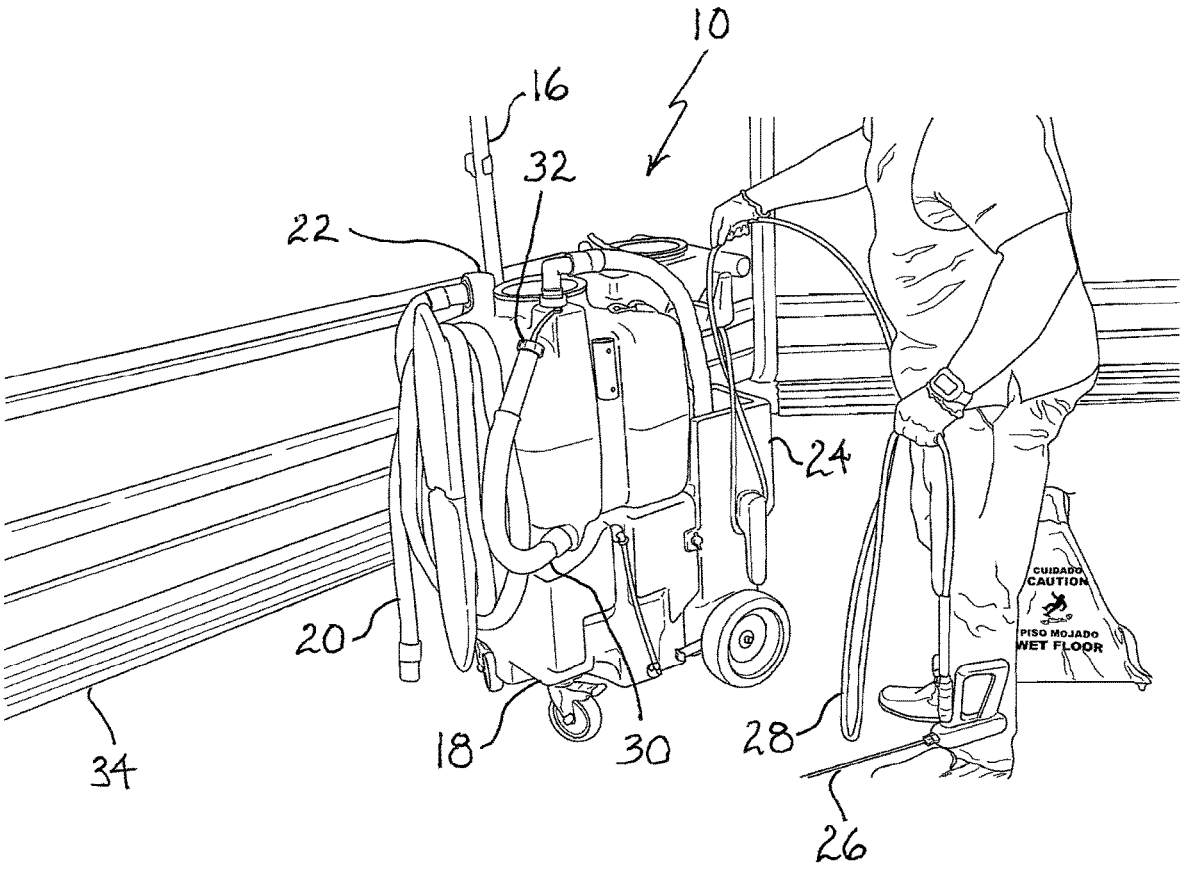
FIG. 2 is a perspective view of the portable cleaning system of FIG. 1 positioned in front of a cooler case to be cleaned.
Figure 3:
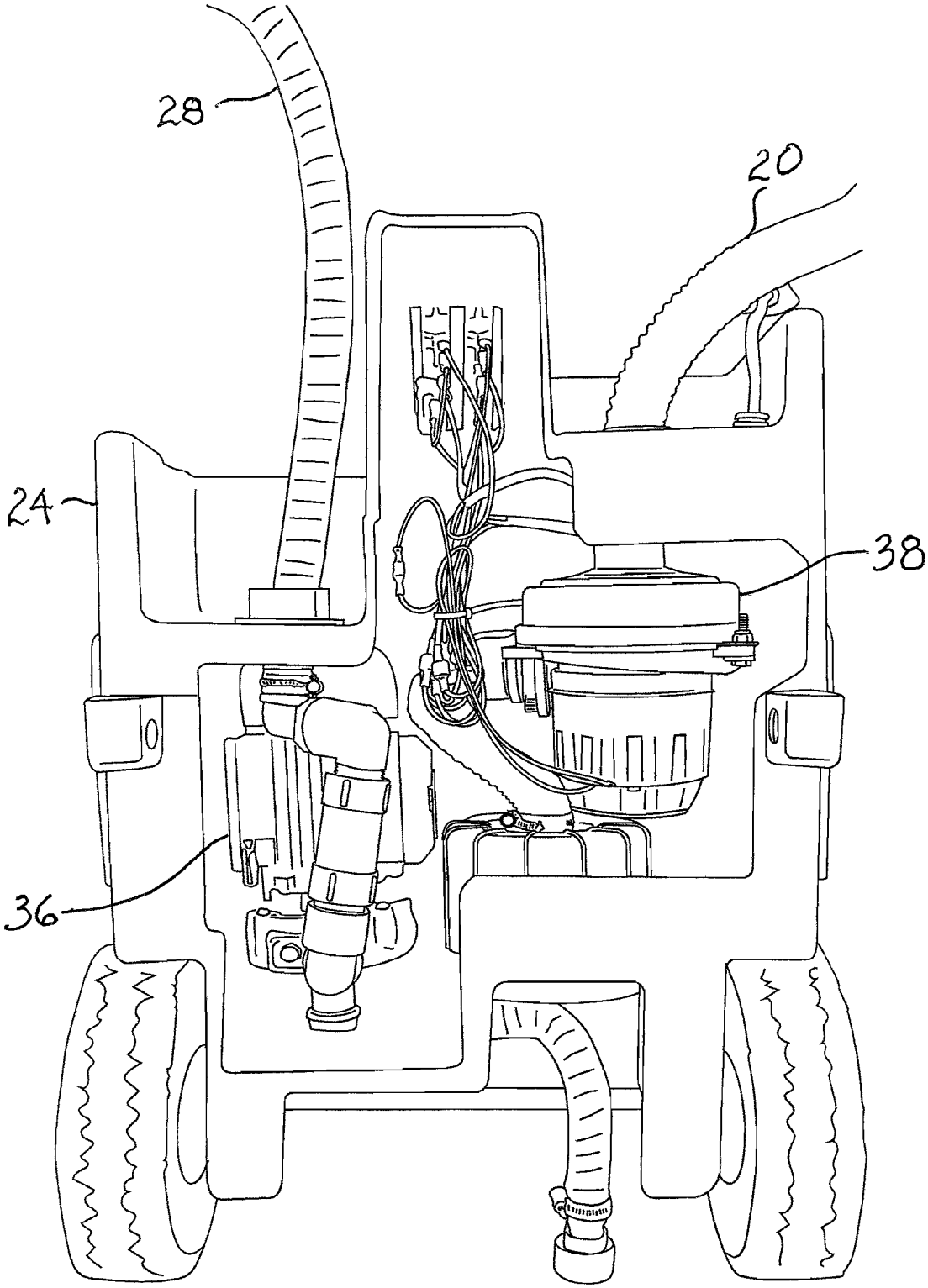
FIG. 3 is a perspective view of an electromechanical housing of the portable cleaning system of FIG. 1, as well as several components connected to the electromechanical housing.
Figure 4:
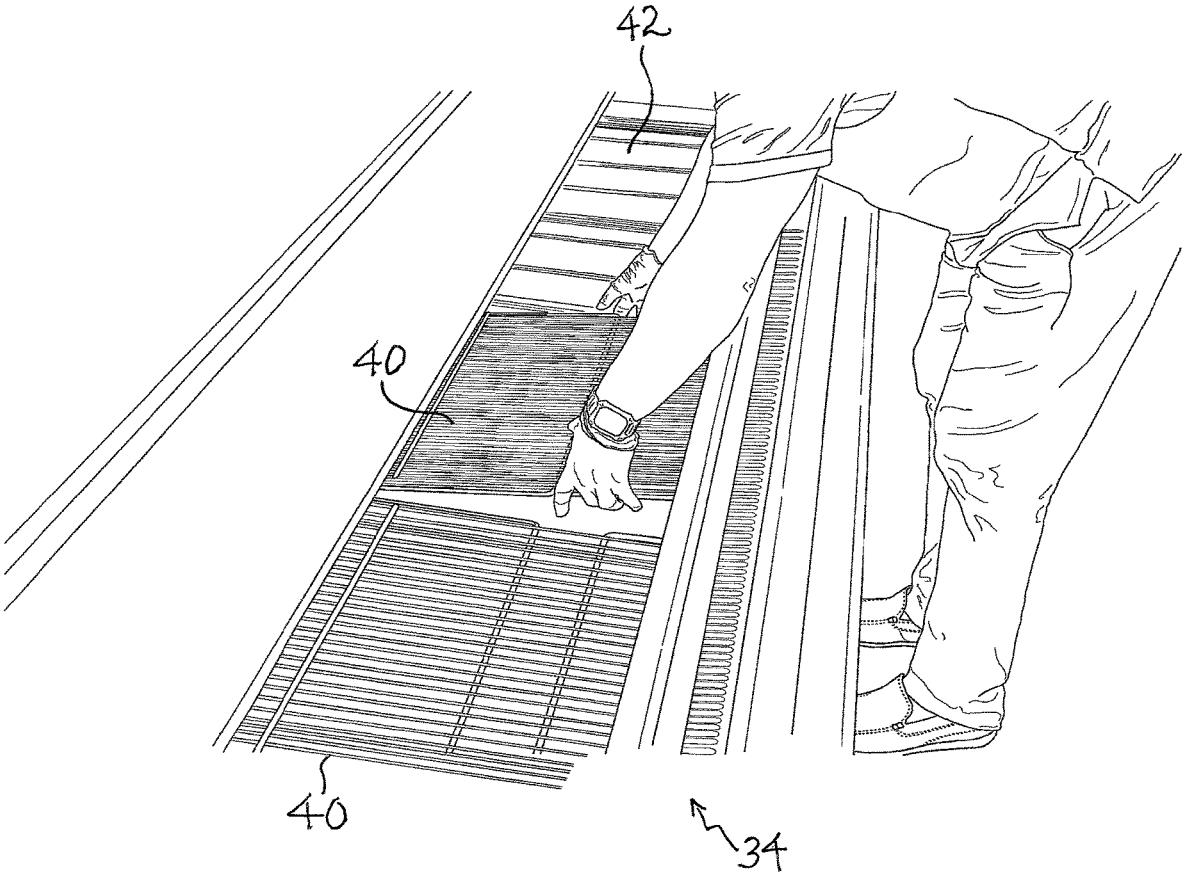
FIG. 4 is a perspective view of a portion of the cooler case of FIG. 2.
Figure 5:
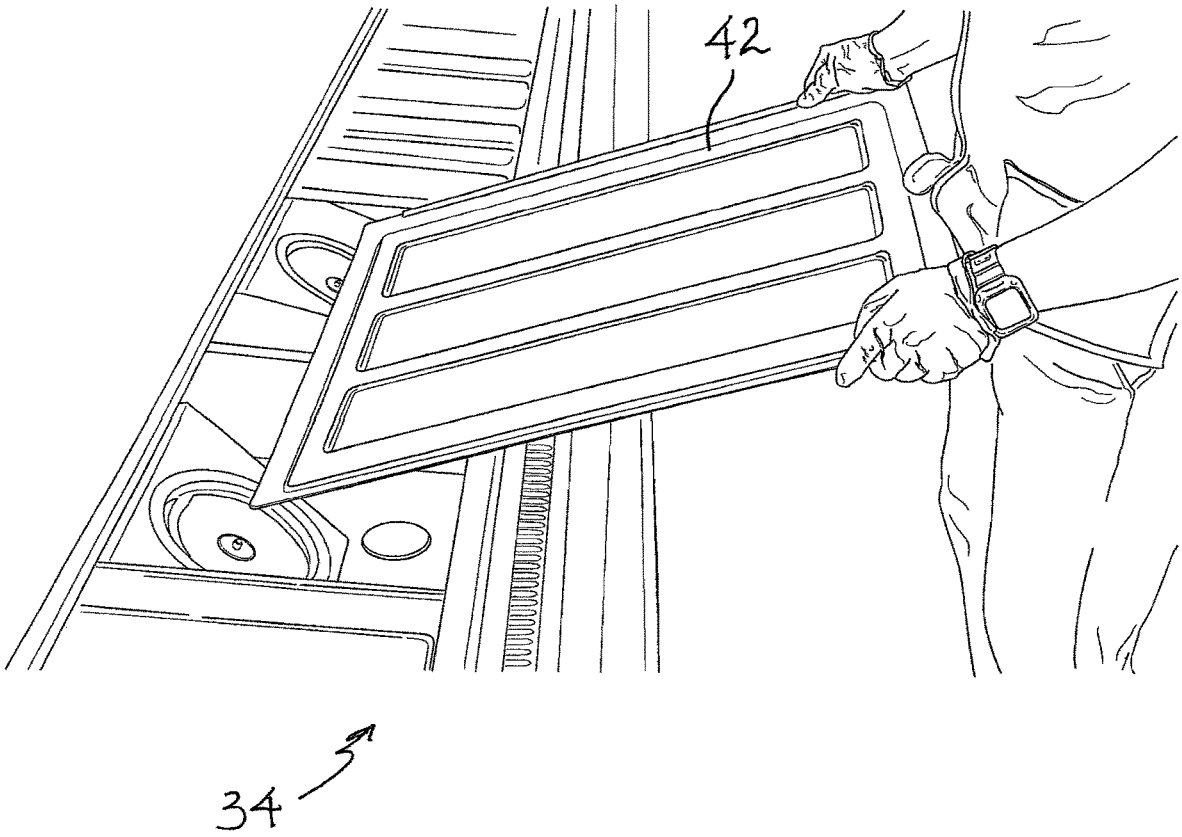
FIG. 5 is a perspective view of a portion of the cooler case of FIG. 2.
Figure 6:
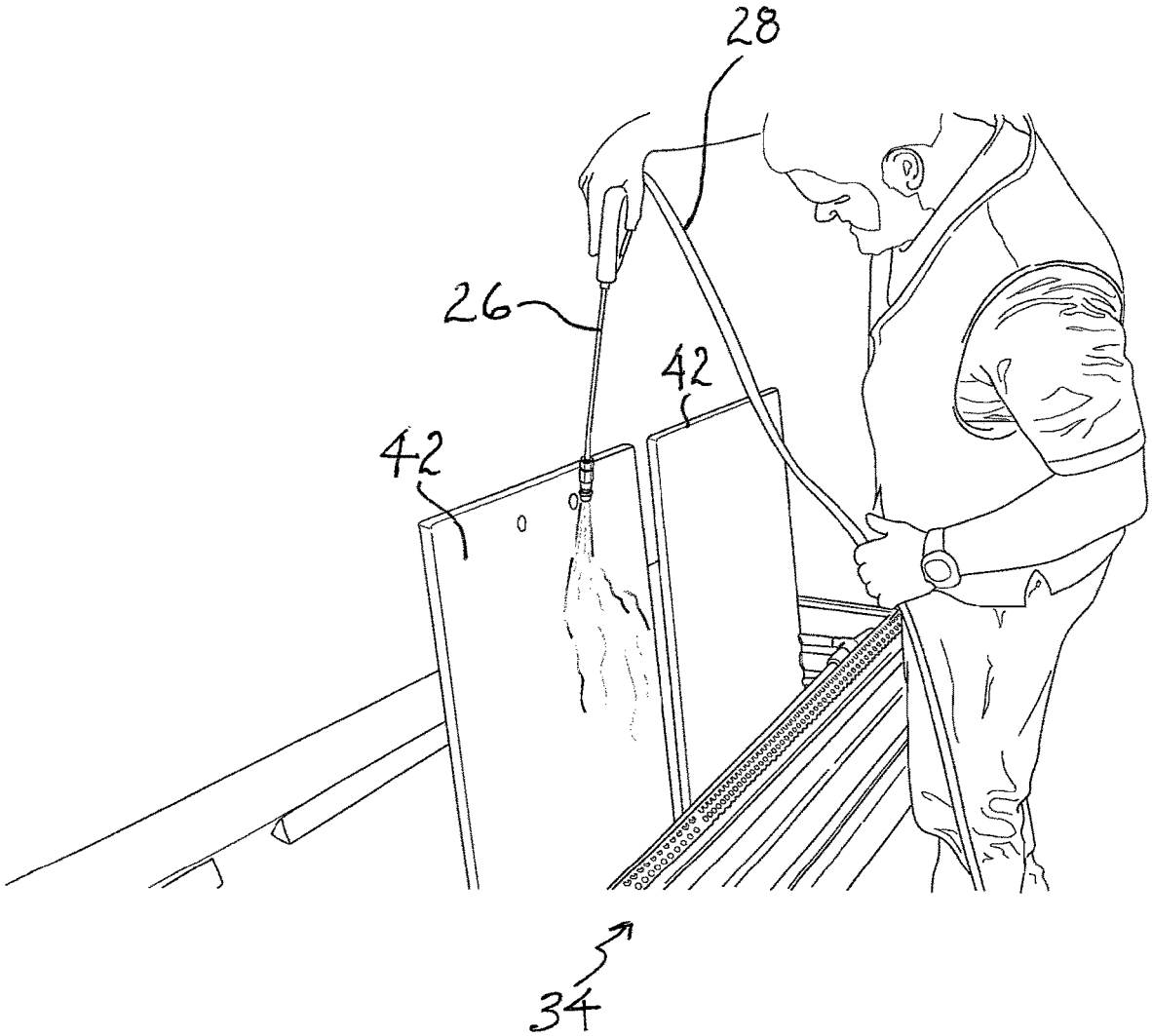
FIG. 6 is a perspective view of a portion of the cooler case of FIG. 2, with two of the cooler case drip trays positioned upright within the cooler case.
Figure 7:
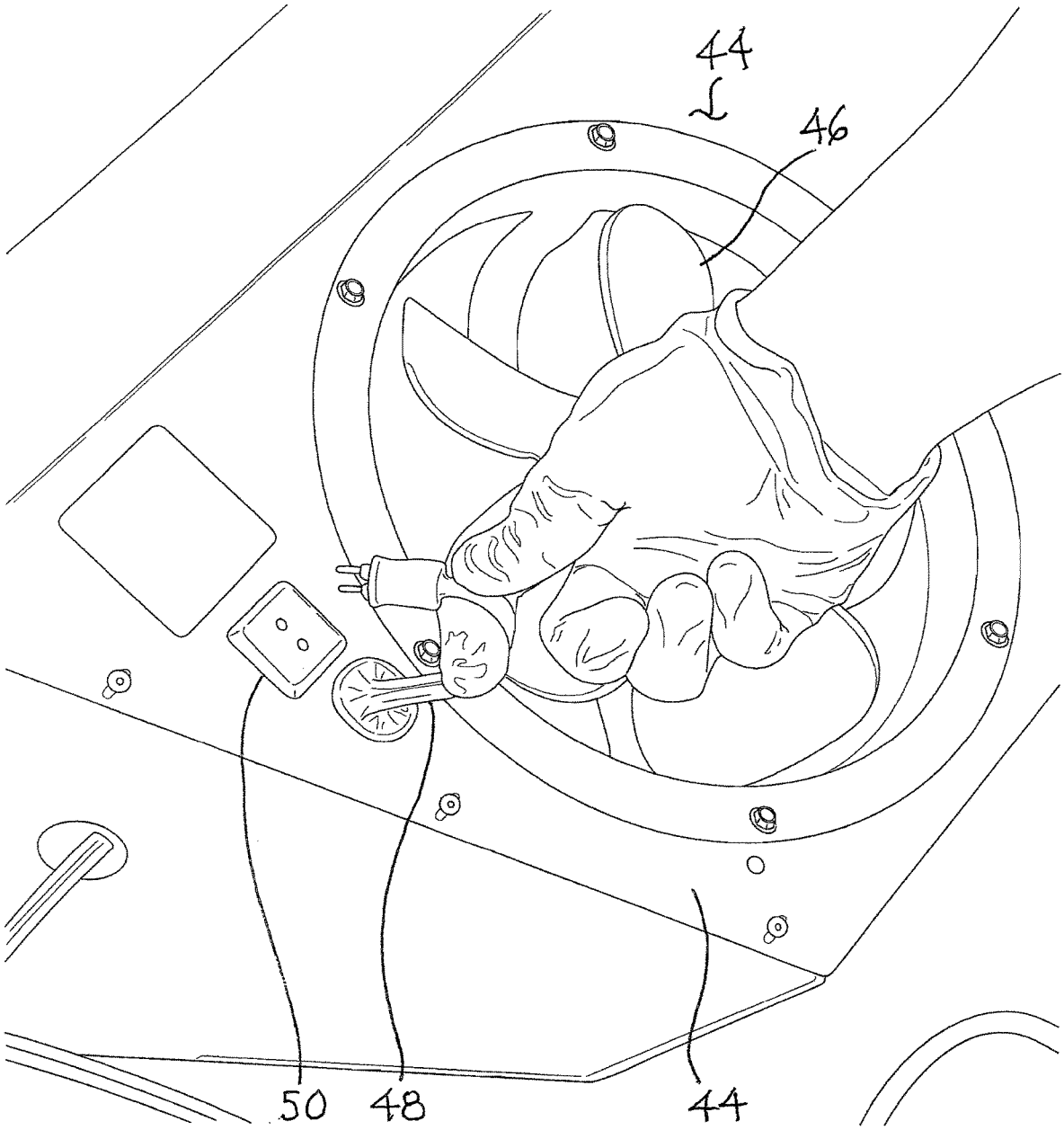
FIG. 7 is a perspective view of a portion of the cooler case of FIG. 2.
Figure 8:
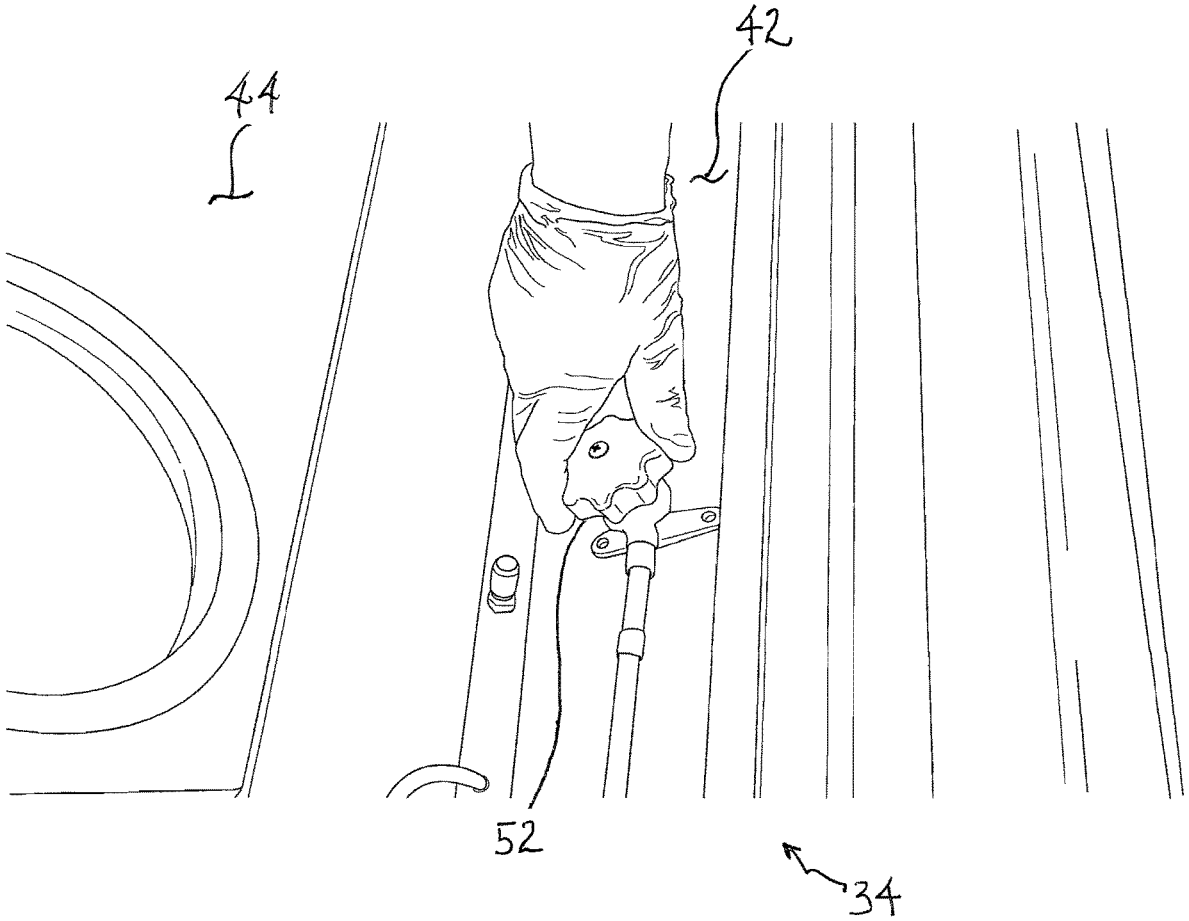
FIG. 8 is a perspective view of a portion of the cooler case of FIG. 2.
Figure 9:
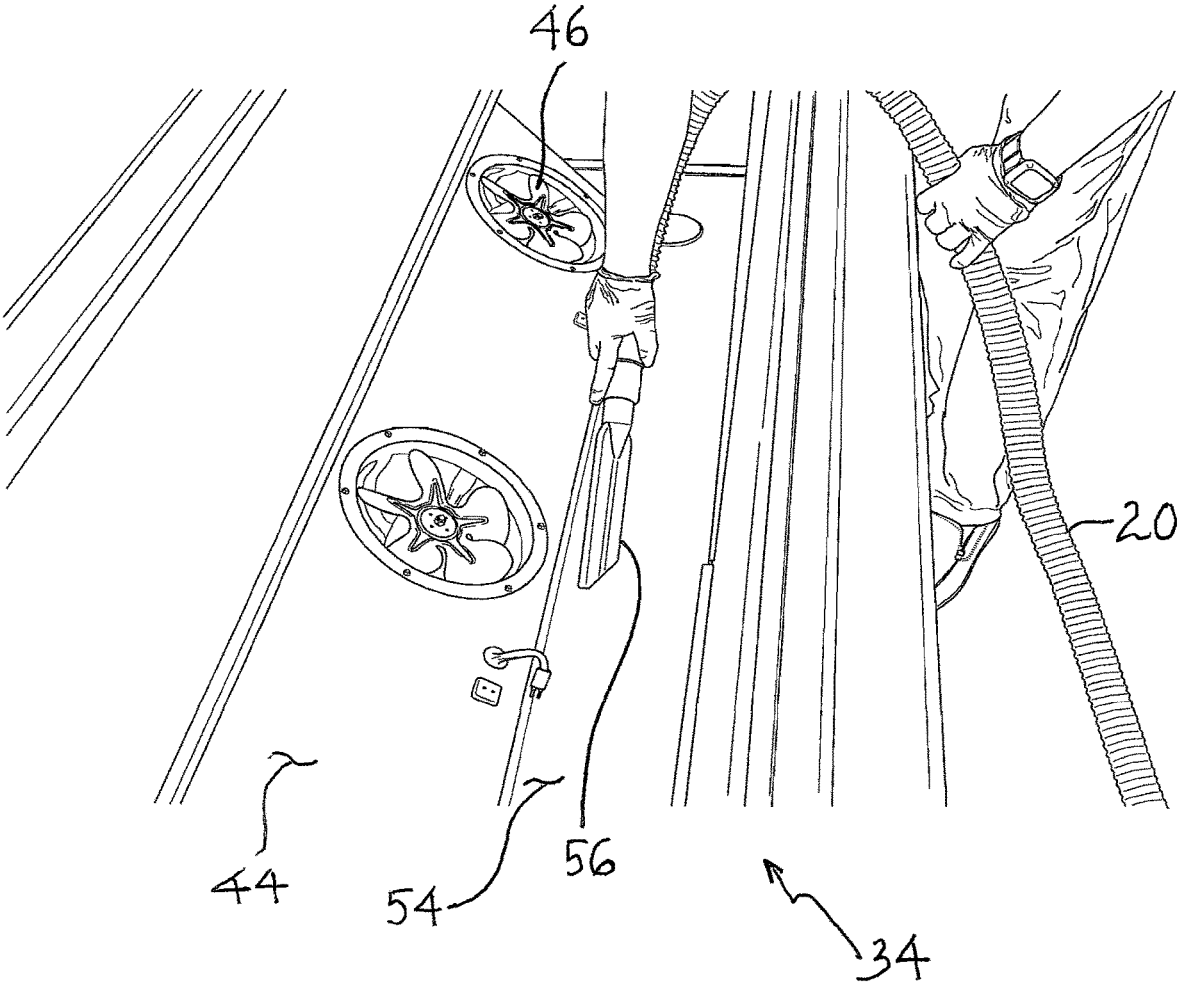
FIG. 9 is a perspective view of a portion of the cooler case of FIG. 2.
Figure 10:
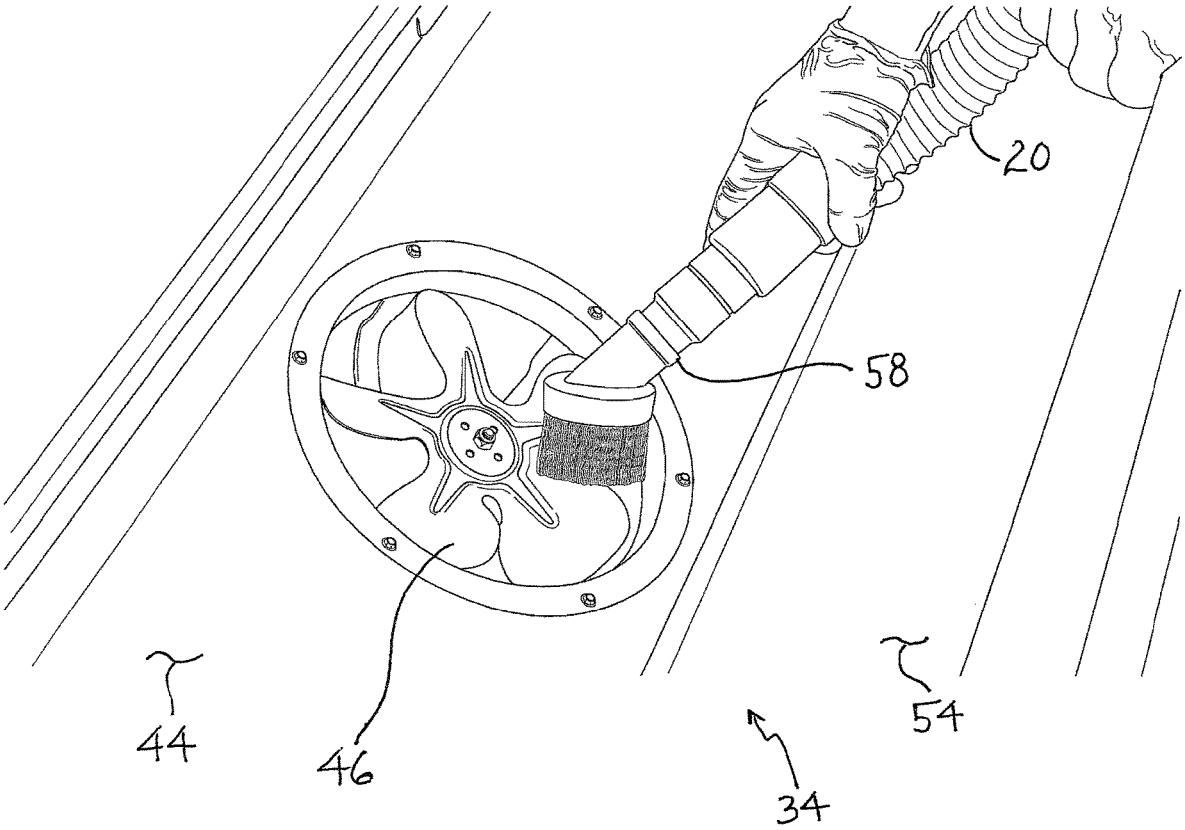
FIG. 10 is a perspective view of a portion of the cooler case of FIG. 2.
Figure 11:
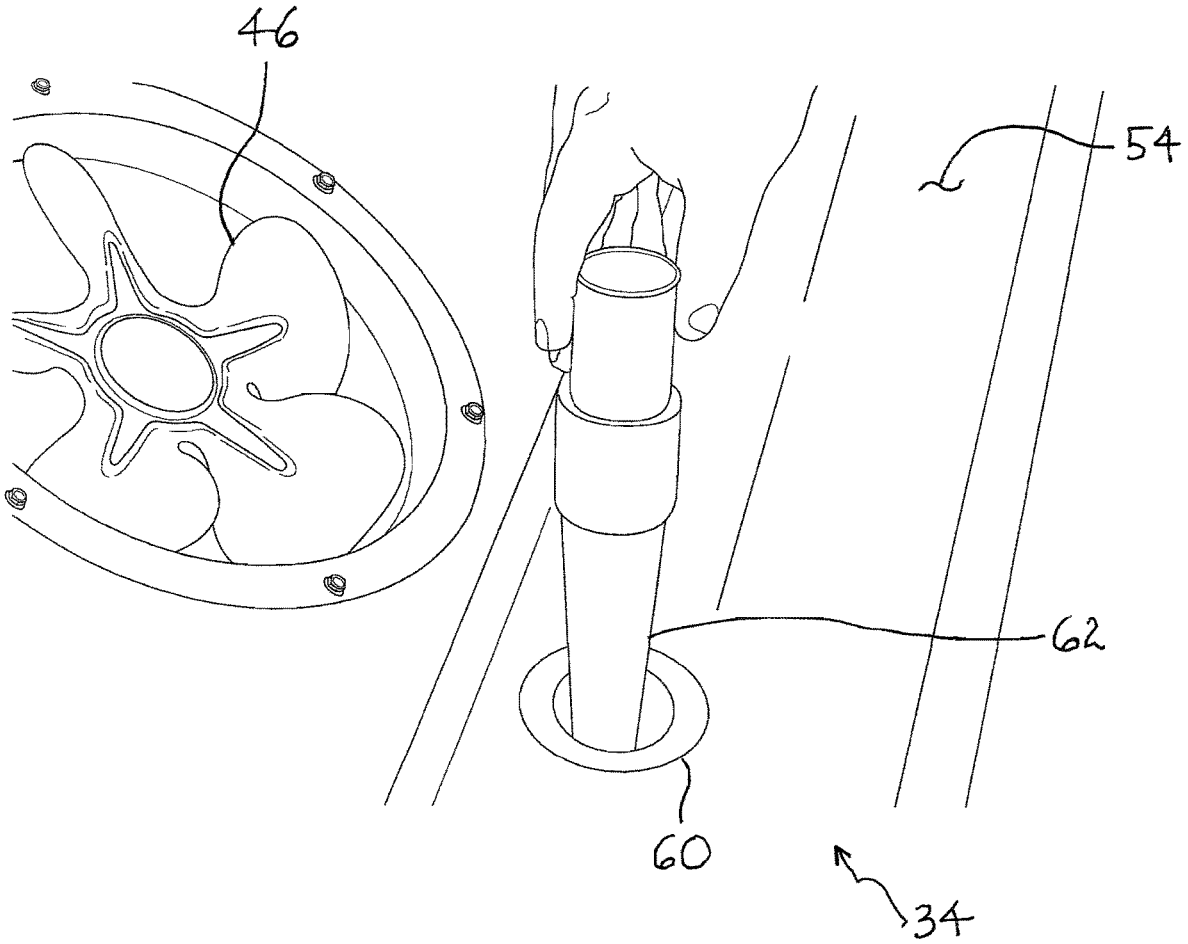
FIG. 11 is a perspective view of a portion of the cooler case of FIG. 2.
Figure 12:
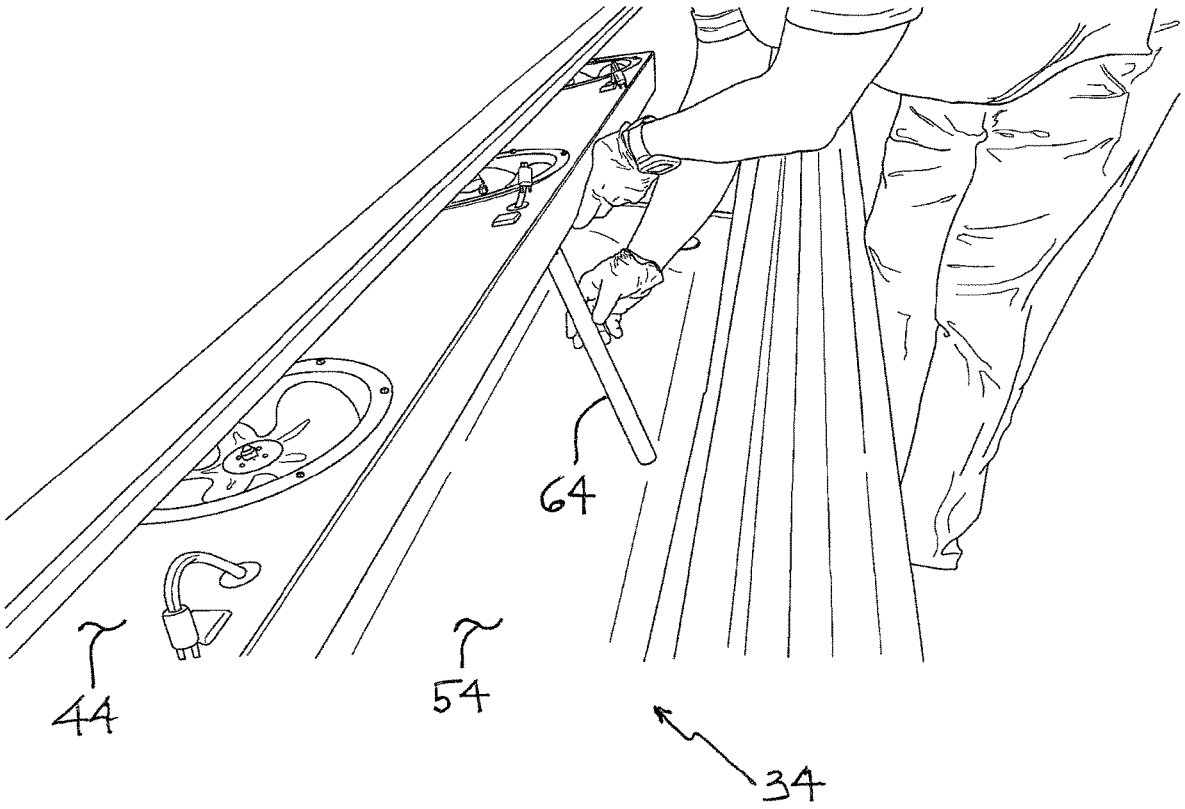
FIG. 12 is a perspective view of a portion of the cooler case of FIG. 2.
Figure 13:
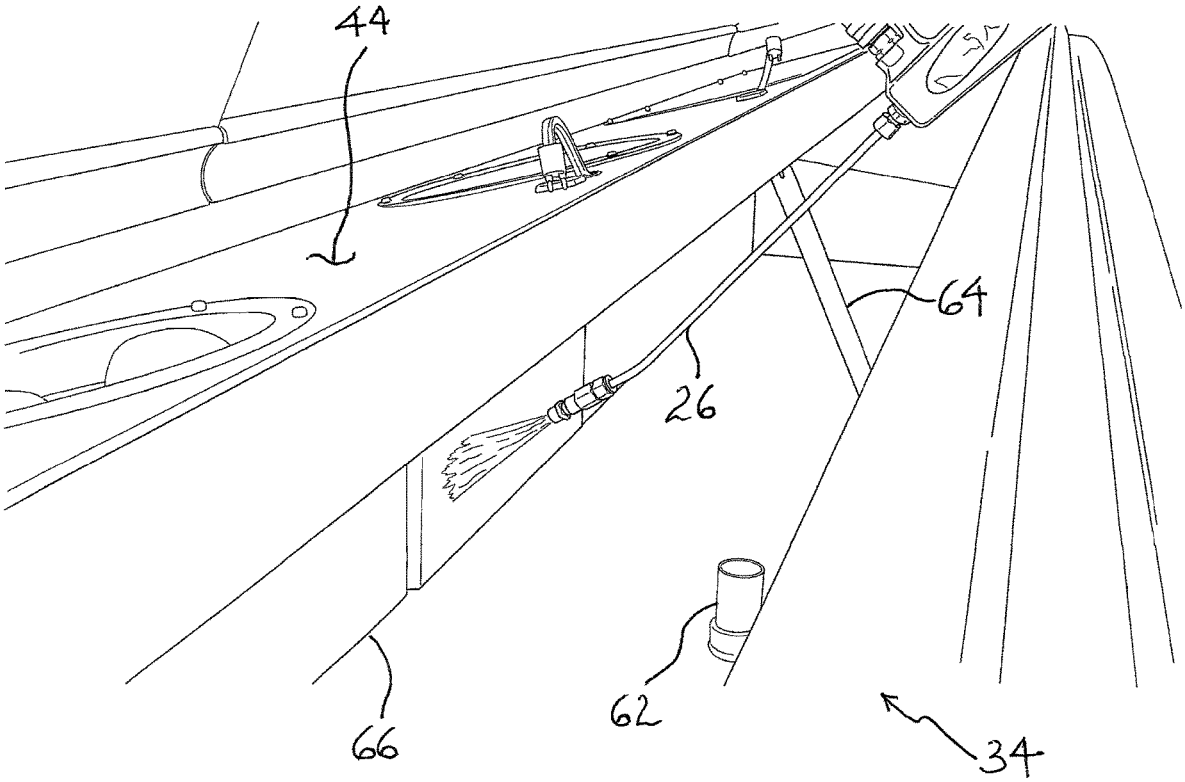
FIG. 13 is a perspective view of a portion of the cooler case of FIG. 2, with a temporary support member (a.k.a. fan lift tool) supporting the fan housing in an upright position, and with the drain stopper tool positioned in the drain.
Figure 14:
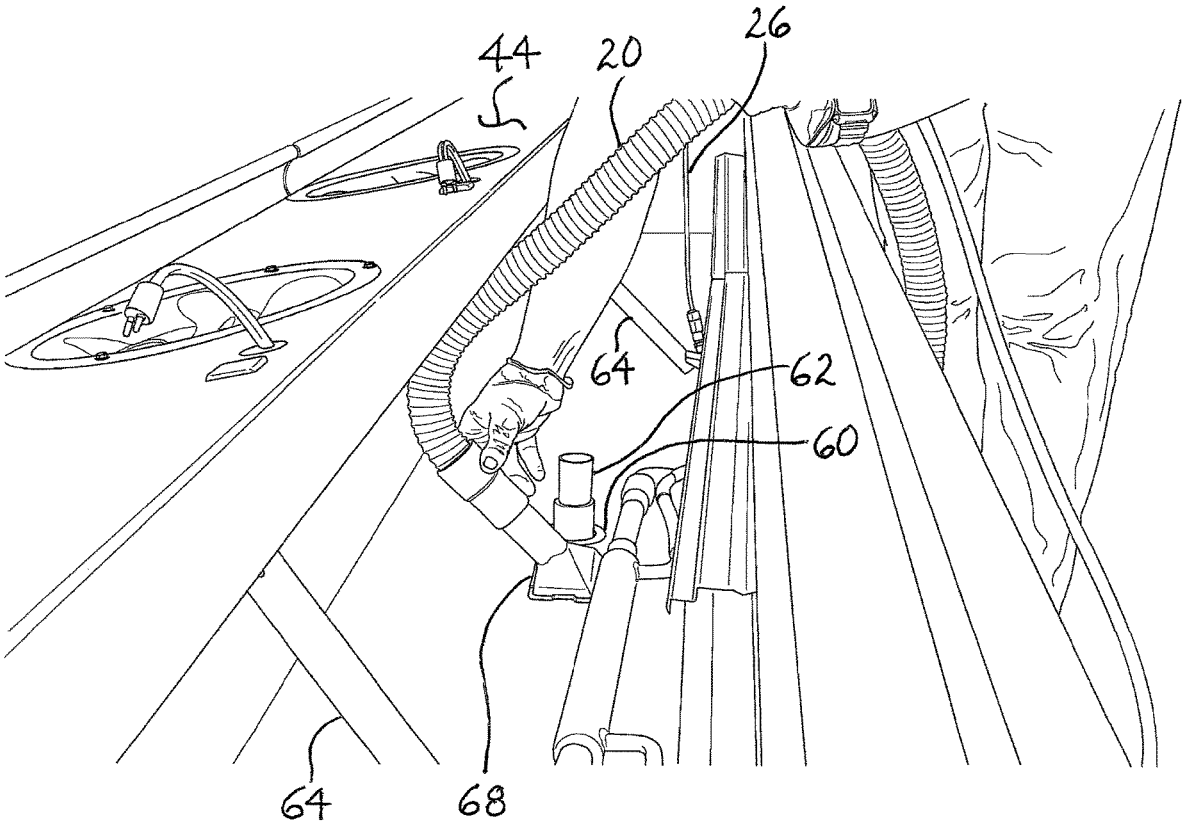
FIG. 14 is a perspective view of a portion of the cooler case of FIG. 2, with temporary support members (a.k.a. fan lift tools) supporting the fan housing in an upright position, and with the drain stopper positioned in the drain.
Figure 15:
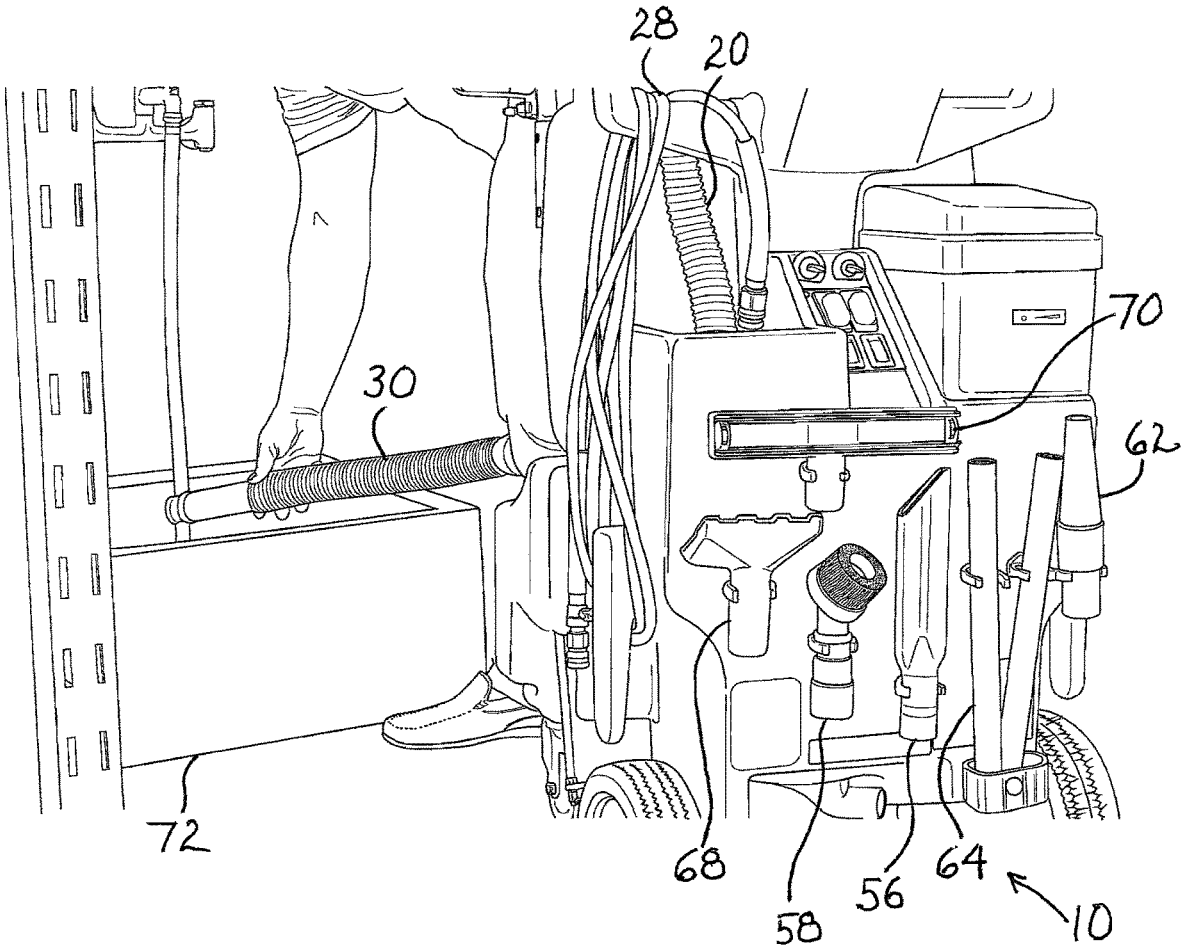
FIG. 15 is a perspective view of a portion of the portable cleaning system of FIG. 1 positioned in front of a floor sink.
Figure 16:
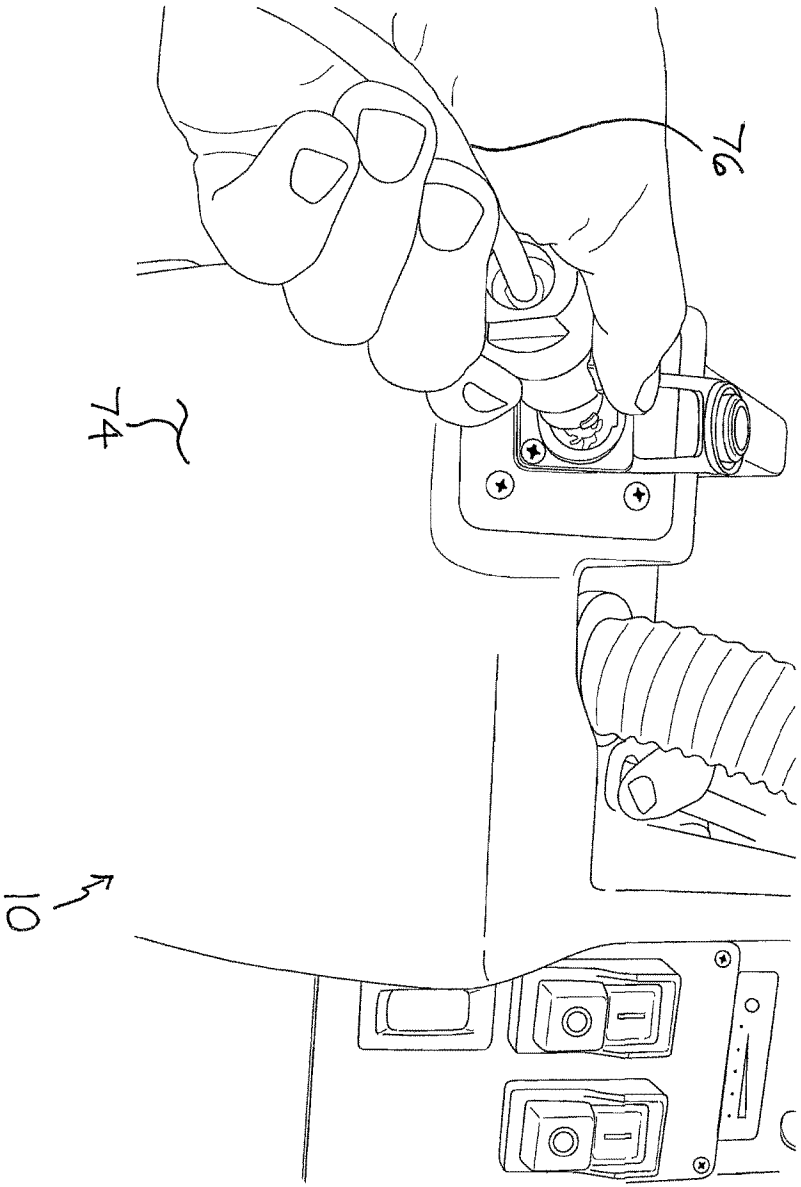
FIG. 16 is a perspective view of a portion of the portable cleaning system of FIG. 1, including a battery box having a charging port.

With reference to FIGS. 1-16, the reference numbers identify various items, elements, features, and/or components of the particular embodiments of the system and the method, in accordance with the principles of the invention, as follows:

| | |
|---|---|
| 10 | particular portable cleaning system embodiment |
| 12 | universal fill hose |
| 14 | hot water faucet |
| 16 | vacuum wand |
| 18 | liquid tank (also referred to as clean water tank) |
| 20 | vacuum hose |
| 22 | vacuum recovery tank |
| 24 | electromechanical housing (also referred to as black box) |
| 26 | spray wand |
| 28 | spray hose (also referred to as spray line) |
| 30 | dump hose |
| 32 | dump hose cap |
| 34 | cooler case |
| 36 | pump |
| 38 | vacuum motor assembly |
| 40 | open rack |
| 42 | drip tray |
| 44 | fan housing |
| 46 | fan |
| 48 | fan power cord |
| 50 | fan housing power outlet |
| 52 | coolant valve |
| 54 | drain pan |
| 56 | crevice tool |
| 58 | dusting brush tool |
| 60 | drain |
| 62 | drain stopper tool |
| 64 | temporary support member (also referred to as fan lift tool) |
| 66 | coolant coil |
| 68 | suction tool (also referred to as Insta-Drain tool) |
| 70 | squeegee floor tool |
| 72 | floor sink |
| 74 | lithium-ion battery |
| 76 | battery charger |

Portable Cleaning System Overview

Keeping your commercial refrigeration units clean is critical for optimum performance and to ensure food quality and safety. Dirty and clogged condenser coils are a leading cause of refrigeration inefficiency and even failure. But cleaning cooler cases can be a difficult and time-consuming task. That's why Kaivac created the portable cleaning system—a simple, effective solution for successful maintenance of your commercial cases.

The portable cleaning system features a specially designed, built-in indoor pressure washer and a powerful wet vacuum that work together to produce clean, safe and odor free cases operating at peak efficiency. And cleaning cooler cases with the portable cleaning system takes less than half the time of conventional methods. The portable cleaning system embodiment includes an indoor pressure washer, a 15-foot spray line, a spray wand, a 3-stage wet vacuum, a 15-foot vacuum hose, a one-piece vacuum wand, a large capacity clean water tank, a 17-gallon vacuum recovery tank, a lithium-ion battery and charger, and a number of tools and attachments to assist in cleaning commercial food or beverage refrigeration units.

This worker-friendly system is easy to use and easy to learn. To begin, simply fill the system's fresh water tank with hot water and remove all product from the cooler case. Then, use the indoor pressure washer to flush dirt and debris from the fan housing and condenser coils. Unlike traditional pressure washers which can damage sensitive components, the portable cleaning system provides the perfect balance of water pressure and volume for effective results without harming expensive equipment. The system's powerful wet vacuum recovers liquid, soil and other matter, preventing soils from entering the case drain which could lead to clogging. The portable cleaning system is also equipped with specialty tools and attachments designed to make case cleaning quick and easy.

When cleaning tasks have been completed, the recovery tank can be easily emptied using the built-in drain hose. Simply empty the vacuum tank and rinse the inside of the tank to keep it clean and ready for use. Then, plug the battery in to charge the system's lithium-ion battery.

Setting Up the Portable Cleaning System

Before we begin cleaning, we'll set up the portable cleaning system. The process is quick and easy, so let's get started. To begin, we'll gather all the necessary tools we'll need to perform our cleaning operations. Make sure the vacuum wand, Insta-Drain Tool, Fan Lift Tools, Crevice Tool, Dusting Brush and Drain Stopper Tool are attached to the portable cleaning system. Now is also a good time to put on the appropriate protective equipment, including gloves and safety glasses.

Next, wheel the system to a water source to fill it with water. If desired, the portable cleaning system may be filled with hot water. Preferably, other cleaning chemicals are not used when filling the system, as doing so could cause damage to the system's internal pump as well as the cooler's coils. To fill the system, remove the black lid on the top of the fresh water tank and set it aside. If your sink is equipped with a hose, insert the hose into the top of the fresh water tank and turn on the water to fill the tank. For sinks not equipped with a hose, use the universal fill hose to fill the tank. Simply extend the hose from the cart and attach the hose to the faucet. Turn on the water and fill the system. When the fresh water tank is full, turn off the water and replace the black lid on the top of the fresh water tank.

Finally, check the charge level of the battery by pressing the TEST button located on the rear of the system. To charge the battery, locate the charger port on the side of the battery box and insert the charger's plug. The plug is keyed and will only fit one way. Align the tabs on the plug with the slots in the battery's power port and seat the plug fully into the receptacle. Now twist the plug clockwise from the 11:00 position to the 12:00 position until you hear it click into place. With the charger connected, plug the charger into an electrical outlet to begin charging. During the charging process a red LED light on the charger indicates that the battery is still charging. A green light indicates that the battery is fully charged. Once the battery has been charged, disconnect the charger from the battery by sliding the locking tab back and rotating the plug in a counter-clockwise direction from the 12:00 position to the 11:00 position, and pulling the plug out of the receptacle.

Preparing the Cooler Case

Once the portable cleaning system is set up we'll prepare the cooler for cleaning. Begin by removing all product from the cooler case. Place the product on a rolling cart for temporary storage in a walk-in cooler while we're cleaning the case. As you remove product, place it on the cart in an organized fashion to make re-stocking the case after cleaning easier. Once all of the product is removed from the case, roll the cart to a walk-in cooler for cold storage during the cleaning process.

Cleaning the Cooler Case

Now that the portable cleaning system is set up and the case has been prepared we're ready to start cleaning. To begin, attach the spray wand to the spray hose. Pull back on the spray line collar and insert the spray wand fully. Then, release the collar, locking the spray wand in place. Next, unwrap the spray line and turn on the pump using the switch on the rear of the system.

Using the portable cleaning system's spray wand, rinse the tops of the case racks to wash away soils. If necessary, use the scrub brush to loosen any stubborn soils. Once the racks have been rinsed, remove them from the case and set them aside. When all of the racks have been rinsed, lift each case tray and rinse soils away from the top and bottom of the tray. The scrub brush can be used if necessary to remove stubborn soils. Rinse all of the case trays and set them aside. Then, remove any large debris that may have fallen into the case. Now, unplug the fans from the fan housing. When all of the fans have been unplugged, turn the coolant valve in a clockwise direction to the fully closed position.

Next, return to the system and locate the Crevice tool attached to the system's black box. Attach the crevice tool to the vacuum hose and turn on the vacuum motor. Use the crevice tool to vacuum away any soils or standing water inside the cooler case. Now, return to the system and locate the dusting brush attached to the black box. Attach the dusting brush to the vacuum hose and use it to clean dust from the fan blades. Next, place the stopper tool in the case drain to prevent debris from entering the drain as we rinse the inside of the case. Turn the pump on and use the spray wand to rinse the fan housing.

Once the fan housing has been rinsed, grab the fan lift tools from the rear of the system and use them to prop the fan housing in an upright position while we clean the case coils. Use the spray wand to rinse dirt and debris from the coils. Rinse the coils from top to bottom being careful not to touch the coil fins with the tip of the spray wand. If the inside of the case is particularly soiled, use the scrub brush to scour the surface and loosen any soils.

Now, return to the system and attach the Insta-Drain tool to the vacuum hose and turn on the vacuum. Place the Insta-Drain tool in the bottom of the case to one side of the drain, allowing the suction from the vacuum to hold it in place. The Insta-Drain tool recovers excess water and soil as you're cleaning, keeping the case drain clean. Continue rinsing the coils with the spray wand, allowing the water and soils to be recovered through the vacuum hose.

Once the coils have been rinsed, turn the pump off and wrap the spray line back onto the system. Next, remove the Insta-Drain tool from the vacuum hose and wrap the vacuum hose back onto the system, leaving the vacuum running to avoid drips. When the hose is wrapped, turn the vacuum off.

Now, remove the fan lift tools and lower the fan housing into place. Plug the fans in and turn the coolant valve in a counter-clockwise direction to the full open position. Then, replace the case trays and racks. If there is standing water on the floor in front of the refrigeration unit. you can use the vacuum wand to remove it. Attach the vacuum wand to the vacuum hose; and turn on the vacuum. Then vacuum the floor around the case leaving it clean and dry. The dusting brush can be used to clean dust from overhead vents as necessary. Once the case has been cleaned, we're ready to place product back into the cooler.

Restocking the Cooler Case

Once the cooler has been cleaned we're ready to re-stock the unit with product. To restock the case, wheel the rack from cold storage to the cooler and replace product in the reverse order from which it was removed. Finish re-stocking the cooler and continue to the next cooler to be cleaned. If you are finished cleaning for the day, it's time to empty and rinse the vacuum tank.

Emptying and Rinsing the Portable Cleaning System

When you've finished with your cleaning tasks it's time to empty the vacuum tank. Wheel the system to a floor sink and let's get started. To begin, we'll vacuum any remaining water from the fresh water tank. This will accomplish two things. First, it will empty the fresh water tank so that when you fill it the next time, if hot water is used, the water will remain hot for cooler cleaning operations. Second, it will clean the inside of the vacuum hose keeping your system clean and in tip-top shape. Unwrap the vacuum hose completely from the system to allow for maximum vacuum lift. Then, turn on the vacuum and place the vacuum hose in the fresh water tank to remove any remaining water in the tank. Once all the water has been vacuumed from the fresh water tank, wrap the vacuum hose back onto the system, leaving the vacuum running to avoid drips. Then turn off the vacuum.

Now, locate the dump hose of the front of the system and remove the cap from the dump hose. Hold the hose in an upright position, then quickly lower it into the floor sink to allow the contents of the vacuum tank to drain out. When the tank is empty, leave the dump hose in the floor sink and remove the black lid from the top of the vacuum tank. Now, grab a hose and rinse the inside of the vacuum tank allowing the water to flush out through the dump hose. Pay particular attention to the float cage on the inside of the vacuum tank, rinsing any debris that may be caught in the cage. This step can be very important and can be performed on a daily basis. A clogged float screen could negatively impact the performance of the vacuum. Once the tank has been rinsed, turn off the water and replace the vacuum tank lid. Then, reattach the dump hose to the vacuum tank.

Finally, plug the battery into the charger. Insert the charger plug into the charging port on the side of the battery box. Line the tabs on the charger plug up with the slots in the charger port and seat the plug fully into the receptacle. Then rotate the charger plug in a clockwise direction from the 11:00 position to the 12:00 position until you hear it click and lock in place. Plug the charger into an electrical outlet and allow it to charge.

While the present invention has been illustrated by a description of embodiments, and while the illustrative embodiments have been described in considerable detail, it is not the intention of the inventors to restrict or in any way limit the scope of the invention to such detail. Additional advantages and modifications readily will appear to those skilled in the art upon a reading of this patent document. The invention, in its broader aspects, is therefore not limited to the specific details, representative apparatus and methods, and illustrative examples shown and described in this patent document. Accordingly, departures may be made from such details without departing from the spirit or scope of the inventors' general inventive concept.

What is claimed is:

1. A method of cleaning a commercial food or beverage refrigeration unit, the refrigeration unit comprising at least one open rack, at least one drip tray, a fan, a fan housing, a fan power cord, a fan housing power outlet, a coolant, a coolant coil, a drain pan, and a drain, the method comprising:

providing a portable cleaning system, comprising:

a liquid tank;

a pump fluidly connected to the liquid tank;

a vacuum recovery tank;

a vacuum motor assembly fluidly connected to the vacuum recovery tank;

a spray wand fluidly connectable to the pump and the liquid tank;

a drain stopper; and a suction tool fluidly connectable to the vacuum recovery tank;

filling at least a portion of the liquid tank with a liquid;

rinsing the at least one open rack by spraying liquid with the spray wand from the liquid tank onto the at least one open rack;

removing the at least one open rack from the refrigeration unit;

rinsing the at least one drip tray by spraying liquid with the spray wand from the liquid tank onto the at least one drip tray;

removing the at least one drip tray from the refrigeration unit;

stopping the fan;

stopping a flow of the coolant;

positioning the drain stopper in the drain;

elevating a front portion of the fan housing, thereby providing spraying access to the coolant coil;

rinsing the coolant coil by spraying liquid with the spray wand from the liquid tank onto the coolant coil;

positioning the suction tool on the drain pan, with the suction tool fluidly connected to the vacuum recovery tank; and vacuuming soil and sprayed liquid through the suction tool into the vacuum recovery tank.

2. The method of claim 1 further including positioning at least one temporary support member between the front portion of the fan housing and the drain pan, to facilitate temporarily maintaining the front portion in an elevated position.

3. The method of claim 1 further including scrubbing one or more of the at least one open rack, the at least one drip tray, and the drain pan.

4. The method of claim 1 further including vacuuming dust from the fan into the vacuum recovery tank.

5. The method of claim 1 wherein suction from the vacuum motor assembly releasably maintains the suction tool in place when the suction tool is positioned on the drain pan.

6. The method of claim 1 wherein the liquid entering the liquid tank during filling has a temperature above ambient temperature.

7. The method of claim 1 wherein the liquid entering the liquid tank during filling is water, and wherein the liquid used in rinsing is water.

8. The method of claim 1 wherein the portable cleaning system further includes a vacuum hose.

9. The method of claim 2 further including: removing the drain stopper from the drain;

removing the suction tool from the refrigeration unit; removing the temporary support member and lowering the front portion of the fan housing; starting the fan; starting the flow of the coolant; and repositioning the drip tray and the open rack in the refrigeration unit.

* * * * *